US008824725B2

(12) United States Patent
Funahashi

(10) Patent No.: US 8,824,725 B2
(45) Date of Patent: Sep. 2, 2014

(54) SPEAKER DIAPHRAGM, SPEAKER USING SAID DIAPHRAGM, AND SPEAKER DIAPHRAGM MANUFACTURING METHOD

(75) Inventor: Osamu Funahashi, Mie (JP)

(73) Assignee: Panasonic Corporation, Osaka (JP)

( * ) Notice: Subject to any disclaimer, the term of this patent is extended or adjusted under 35 U.S.C. 154(b) by 340 days.

(21) Appl. No.: 12/863,852

(22) PCT Filed: Jan. 21, 2009

(86) PCT No.: PCT/JP2009/000193

§ 371 (c)(1),
(2), (4) Date: Jul. 21, 2010

(87) PCT Pub. No.: WO2009/093444

PCT Pub. Date: Jul. 30, 2009

(65) Prior Publication Data

US 2010/0296688 A1 Nov. 25, 2010

(30) Foreign Application Priority Data

Jan. 22, 2008 (JP) ..... 2008-011252
Mar. 27, 2008 (JP) ..... 2008-082796

(51) Int. Cl.

| | |
|---|---|
| ***H04R 7/00*** | (2006.01) |
| ***H04R 9/06*** | (2006.01) |
| ***G10K 13/00*** | (2006.01) |
| ***H04R 7/12*** | (2006.01) |
| ***H04R 31/00*** | (2006.01) |

(52) U.S. Cl.

CPC ..... *H04R 7/125* (2013.01); *H04R 2307/029* (2013.01); *H04R 2307/021* (2013.01); *H04R 31/003* (2013.01)

USPC ..... 381/398; 181/169

(58) Field of Classification Search

USPC ..... 381/398, 423, 426, 428; 181/169, 179, 181/167; 264/624

See application file for complete search history.

(56) References Cited

U.S. PATENT DOCUMENTS

| | | | | |
|---|---|---|---|---|
| 5,274,199 | A | 12/1993 | Uryu et al. | |
| 5,581,053 | A * | 12/1996 | Suzuki et al. | 181/167 |
| 2002/0140136 | A1 * | 10/2002 | Ishigaki et al. | 264/624 |
| 2004/0168851 | A1 * | 9/2004 | Imamura et al. | 181/169 |
| 2005/0009426 | A1 * | 1/2005 | Hwang et al. | 442/59 |
| 2005/0051380 | A1 * | 3/2005 | Takayama et al. | 181/170 |
| 2006/0193488 | A1 * | 8/2006 | Hachiya et al. | 381/423 |
| 2006/0266578 | A1 | 11/2006 | Takayama et al. | |

FOREIGN PATENT DOCUMENTS

| | | | |
|---|---|---|---|
| CN | 1867205 | A | 11/2006 |
| DE | 744286 | C | 1/1944 |
| EP | 0322587 | A2 | 11/1988 |
| JP | 53-95617 | | 8/1978 |

(Continued)

*Primary Examiner* — Duc Nguyen
*Assistant Examiner* — Phan Le
(74) *Attorney, Agent, or Firm* — RatnerPrestia

(57) ABSTRACT

A speaker diaphragm includes a fabric layer in which impregnated thermosetting resin is thermally cured, and a paper layer integrated on a rear face of this fabric layer. Fluffs of the paper layer filling stitches of the fabric layer are entangled with threads of the fabric layer from a surface of the fabric layer, and are firmly fixed by thermosetting resin. This integrates the layers in the state that the paper layer is filled in the stitches of the fabric layer. Accordingly, internal loss and Young's modulus of the speaker diaphragm can be increased. As a result, the speaker sound quality can be improved.

13 Claims, 10 Drawing Sheets

(56) References Cited

FOREIGN PATENT DOCUMENTS

| | | | |
|---|---|---|---|
| JP | 58-053298 | A | 3/1983 |
| JP | 59-106289 | U | 7/1984 |
| JP | 59-106289 | U | 7/1984 |
| JP | 60-047391 | U | 4/1985 |
| JP | 4-367198 | A | 12/1992 |
| JP | 04-367198 | A | 12/1992 |
| JP | 2003-219493 | A | 7/2003 |
| JP | 2005-80098 | A | 3/2005 |
| WO | PCT/JP2009/00193 | | 4/2009 |

* cited by examiner

SPEAKER DIAPHRAGM, SPEAKER USING SAID DIAPHRAGM, AND SPEAKER DIAPHRAGM MANUFACTURING METHOD

This application is a U.S. National Phase Application of PCT International Application PCT/JP2009/000193.

TECHNICAL FIELD

The present invention relates to speaker diaphragms and speakers using the speaker diaphragm.

BACKGROUND ART

A speaker diaphragm employed in a speaker requires a high Young's modulus and moderate internal loss in order to reproduce high-quality sounds from the speaker.

FIG. 17 is a perspective view of a conventional speaker diaphragm. In FIG. 17, speaker diaphragm 204 is configured with laminated body 203 including inorganic fiber fabric 201 and natural fiber nonwoven fabric 202 laminated on the bottom face of inorganic fiber fabric 201. This speaker diaphragm intends to achieve excellent characteristics in both Young's modulus and internal loss by attaching inorganic fiber fabric 201 that has low internal loss but high Young's modulus and natural fiber nonwoven fabric 202 that has low Young's modulus but high internal loss. This technology is disclosed in Patent Literature 1.

However, aforementioned conventional speaker diaphragm 204 is configured by simply attaching inorganic fiber fabric 201 and natural fiber nonwoven fabric 202, which have different natures. Therefore, inorganic fiber fabric 201 and natural fiber nonwoven fabric 202 are not sufficiently integrated. Accordingly, a high Young's modulus of inorganic fiber fabric 201 and high internal loss of natural fiber nonwoven fabric 202 are not fully demonstrated, failing to sufficiently improve the speaker sound quality.

Patent Literature 1: Japanese Patent Unexamined Publication No. 2003-219493

SUMMARY OF THE INVENTION

The present invention improves the speaker sound quality by increasing Young's modulus and internal loss of a speaker diaphragm.

The speaker diaphragm of the present invention includes a fabric layer in which impregnated thermosetting resin is thermally cured, and a paper layer integrated on a rear face of this fabric layer. Fluffs of the paper layer filling stitches of the fabric layer are entangled with threads of the fabric layer from the surface of the fabric layer. The fabric layer and the paper layer are further integrated by thermosetting resin.

Furthermore, the speaker diaphragm of the present invention includes a fabric layer impregnated with thermosetting resin, and a nonwoven fabric layer that is pressure-bonded onto a rear face of this fabric layer by at least applying heat. Bamboo fiber is mixed in the non-woven fabric layer.

With the above structures, the present invention improves the speaker sound quality by increasing Young's modulus and internal loss of the speaker diaphragm.

REFERENCE MARKS IN THE DRAWINGS

Figure 1A:
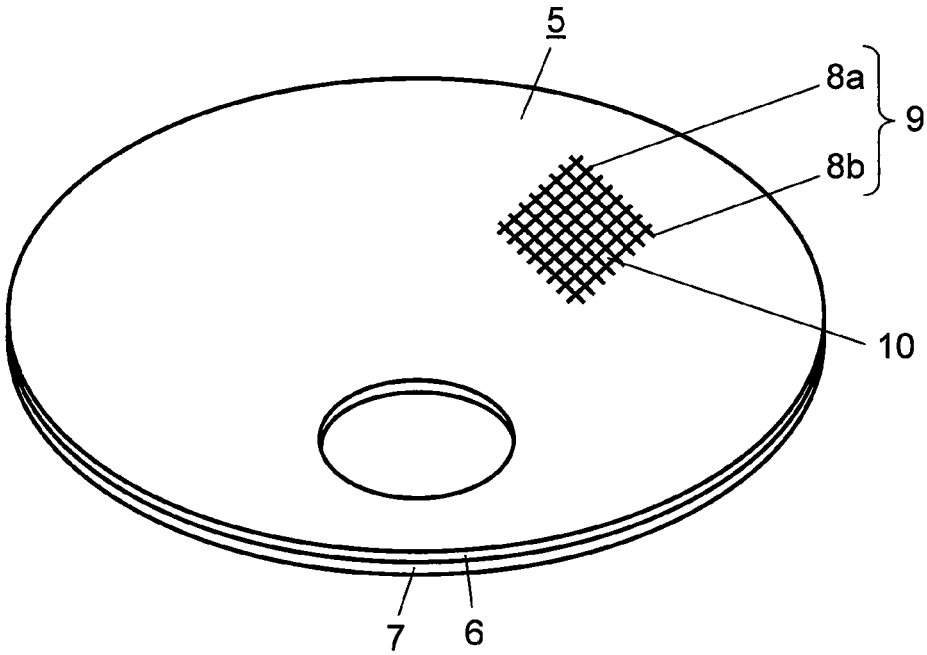
FIG. 1A is a perspective view of a speaker diaphragm in accordance with a first exemplary embodiment of the present invention.

5, 101 Speaker diaphragm
6, 102 Fabric layer
7 Paper layer
7*a*, 104 Fluff
8*a*, 105 Warp
8*b*, 106 Weft
9, 107 Thread
10, 108 Stitch
12, 111 Speaker
13, 112 Magnetic gap
14, 113 Magnetic circuit

15, 114 Coil
16, 115 Voice coil
17, 117 Frame
18, 116 First edge
19, 118 Dust cap
20, 119 Leader line
21, 120 Second edge
21*a*, 121 Suspension holder
22, 122 First mold
23, 123 Second mold
24, 124 Papermaking screen
25 Pulp sedimentary layer
25*a*, 125*a* Fluff
26, 126 Flat fabric
103 Nonwoven fabric layer
125 Sedimentary layer

DETAILED DESCRIPTION OF PREFERRED EMBODIMENTS

Structures of exemplary embodiments of the present invention are described below with reference to drawings.

First Exemplary Embodiment

FIG. 1A is a perspective view of a speaker diaphragm in the first exemplary embodiment of the present invention. In FIG. 1A, speaker diaphragm 5 has a two-layer structure of fabric layer 6 and paper layer 7. Fabric layer 6 is formed by weaving two types of thread 9, i.e., warp 8*a* and weft 8*b*, in a reticular pattern. These reticular stripes are exposed on the surface of speaker diaphragm 5. Thermosetting resin (not illustrated) exists inside and on outer circumference of these warp 8*a* and weft 8*b*. Warp 8*a* and weft 8*b* themselves and fabric layer 6 formed by weaving these threads are hardened by thermally curing this thermosetting resin. This fabric layer 6 contains at least one of high-strength fibers, such as aramid fiber, polyester fiber, acrylic fiber, cotton fiber, carbon fiber, glass fiber, and silk fiber. Thermosetting resin is resin containing at least one of phenol resin, acrylic resin, epoxy resin, and vinylester resin.

Paper layer 7 is formed by mixing aramid fiber with cellulose fiber, and is integrated on the rear face of fabric layer 6 by thermocompression bonding. Since paper layer 7 is integrated on the rear face of fabric layer 6 by thermocompression-bonding, as described above, air does not pass through from the surface to the rear face of speaker diaphragm 5. In addition, pulp configuring this paper layer 7 fills each stitch 10 surrounded by adjacent warp 8*a* and weft 8*b* of fabric layer 6.

Figure 1B:
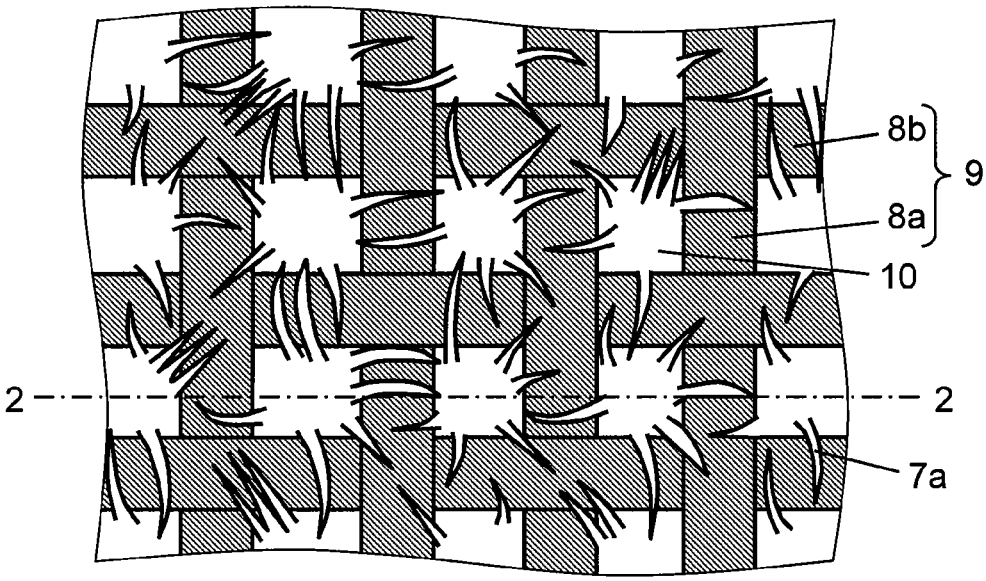
FIG. 1B is a magnified view of an essential part seen from the surface of the speaker diaphragm in accordance with the first exemplary embodiment of the present invention.

FIG. 1B is a magnified view of an essential part seen from the surface of the speaker diaphragm in the first exemplary embodiment of the present invention. In FIG. 1B, pulp fluff 7*a* of paper layer 7 becomes entangled with warp 8*a* and weft 8*b* from the surface of fabric layer 6, and is hardened together with thread 8 by thermosetting resin. Strictly speaking, stitch 10 is a substantially cuboid portion, whose bottom face is surrounded by warp 8*a* and weft 8*b*, with height equivalent to the thickness of thread 9.

Figure 2:
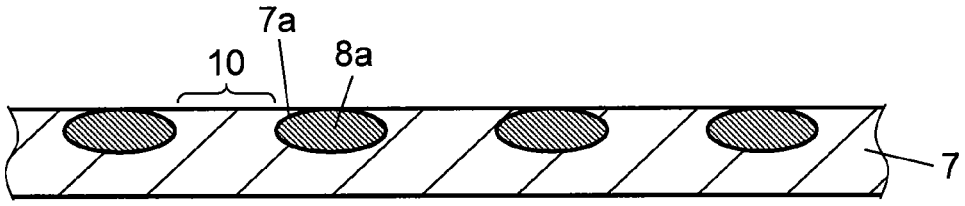
FIG. 2 is a schematic sectional view taken along dotted line 2-2 in FIG. 1B.

FIG. 2 is a schematic sectional view taken along dotted line 2-2 in FIG. 2. In FIG. 2, stitch 10 between warps 8*a* is filled with pulp of paper layer 7 in speaker diaphragm 5. Paper layer 7 is thermocompression-bonded in a state that pulp fluff 7*a* of paper layer 7 is entangled with warp 8*a* from the surface of fabric layer 6. Fluff 7*a* is entangle with warp 8*a* in the drawing, and fluff 7*a* is also entangled with weft 8*b*, in the same way as warp 8*a*.

Figure 3:
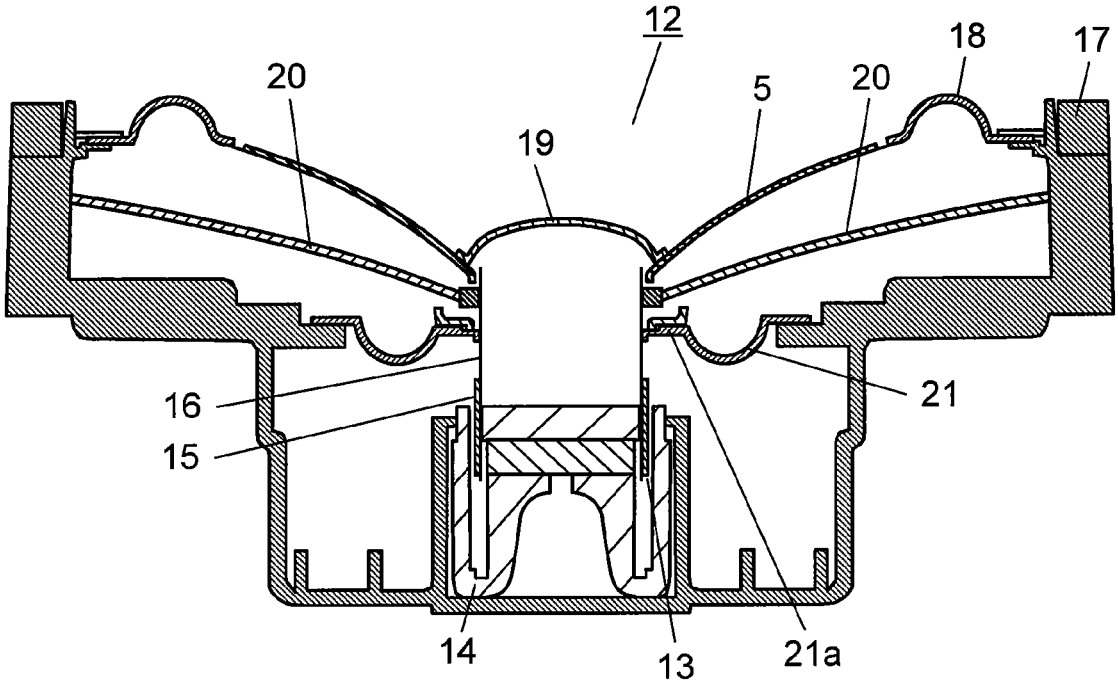
FIG. 3 is a sectional view of a speaker employing the speaker diaphragm in accordance with the first exemplary embodiment of the present invention.

FIG. 3 is a sectional view of a speaker employing the speaker diaphragm in the first exemplary embodiment of the present invention. In FIG. 3, speaker 12 includes magnetic circuit 14 having cylindrical magnetic gap 13, and cylindrical voice coil 16 in which coil 15 is movably disposed inside magnetic gap 13 of this magnetic circuit 14.

An inner circumference of plate-like speaker diaphragm 5 is connected to a portion outside magnetic gap 13 of this voice coil 16. An outer circumference of this speaker diaphragm 5 is connected to an inner circumference of first edge 18, which has ring-like cross section, held at an upper opening of bowl-like frame 17. Dome-like dust cap 19 is provided near the inner circumference of this speaker diaphragm 5, so as to cover the top face of voice coil 16. This dust cap 19 prevents entry of dust or moisture into magnetic gap 13.

Leader line 20 from coil 15 of voice coil 16 is led out from this voice coil 16 between a portion, where speaker diaphragm 5 is connected, and a portion inside magnetic gap 13 to frame 17 without making contact with speaker diaphragm 5.

An inner circumference end of resilient second edge 21, which has a ring-like cross section, is connected to this voice coil 16 via suspension holder 21*a* at a portion between a lead-out point of leader line 20 and a portion inside magnetic gap 13. The other end of this second edge 21 is connected to an inner middle portion of frame 17.

These second edge 21 and first edge 18 are formed of a resilient material such as urethane or rubber. These edges have shapes protruding in opposite directions: second edge 21 protruding downward, and first edge 18 protruding upward.

The shapes of first edge 18 and second edge 21 protruding in opposite directions to each other make upward and downward movable loads of voice coil 16 approximately balanced.

Accordingly, operation of speaker diaphragm 5 also becomes vertically symmetric. As a result, distortion in the sound reproduced from speaker 12 can be reduced.

When audio signal travels in voice coil 16 of speaker 12 as configured above, the audio signal reacts with a magnetic field formed by magnetic gap 13, and a drive force is generated in voice coil 16. This driving direction follows the Fleming's left-hand rule, and voice coil 16 fluctuates vertically. By fluctuation of this voice coil 16, speaker diaphragm 5, whose inner circumference is connected to voice coil, also vertically vibrates. This vibrates air, and the sound is generated from speaker 12.

However, if a speaker diaphragm is formed by overlaying materials with different natures, such as fabric and paper, integration of these materials have not been feasible. As a result, it is difficult to demonstrate the maximum effect of high Young's modulus of the fabric layer and high internal loss of the paper layer, which are firmly fixed by thermosetting resin, in the speaker diaphragm of this structure. Accordingly, the sound quality of speaker has not been sufficiently improved.

Therefore, in speaker diaphragm 5 in the first exemplary embodiment, pulp fluff 7*a* of paper layer 7 filling stitch 10 of fabric layer 6 entangles with thread 9 of fabric layer 6 on the surface of fabric layer 6, and is firmly fixed by thermosetting resin.

By the use of speaker diaphragm 5 adopting the structure that pulp fluff 7*a* fills stitch 10 of fabric layer 6 and is entangled with thread 9 from the surface of fabric layer 6, the sound quality of speaker 12 can be improved.

Figure 17:
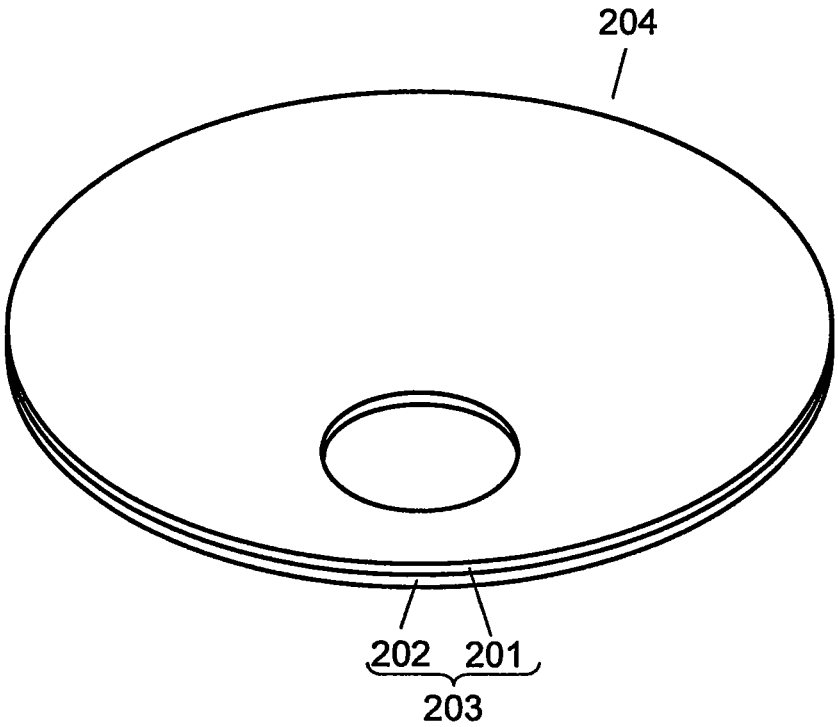
FIG. 17 PRIOR ART
FIG. 17 is a perspective view of a conventional speaker diaphragm.

This is because, firstly, a larger portion of pulp, which has high internal loss, is filled in stitches 10 of fabric layer 6 in speaker diaphragm 5, compared with conventional speaker diaphragm 204 shown in FIG. 17. Accordingly, high internal loss can be gained.

Furthermore, in speaker diaphragm 5, a two-layer structure of paper layer 7 formed by fine linear fibers and fabric layer 6 enables fiber fluffs 7*a* of paper layer 7 to enter stitches 10, and allows fluffs 7*a* to entangle with warps 8*a* and wefts 8*b* of fabric layer 6 from the surface of fabric layer 6. Accordingly, unlike conventional speaker diaphragm 204 with a general structure that only the rear face of fabric layer 6 is attached to paper layer 7, fabric layer 6 and paper layer 7 are integrated. As a result, speaker diaphragm 5 is strengthened, and achieves high Young's modulus, compared to that of conventional speaker diaphragm 204, improving the sound quality.

As described above, speaker diaphragm 5 in the first exemplary embodiment of the present invention improves the sound quality of speaker 12 by increasing internal loss and Young's modulus. In addition, as described above, fabric layer 6 and paper layer 7 are firmly integrated in speaker diaphragm 5. This also significantly reduces a chance of separation of fabric layer 6 and paper layer 7.

Thermosetting resin contained in fabric layer 6 is preferably resin at least containing one of phenol resin, acrylic resin, epoxy resin, and vinylester resin. Any resin containing one of these resins fully cures at thermocompression bonding, and increases hardness of speaker diaphragm 5. This can increase Young's modulus of speaker diaphragm 5.

Aramid fiber may be mixed in paper layer 7. By mixing aramid fiber, which is hard, in paper layer 7, speaker diaphragm 5 can be strengthened, accompanied by increased hardness of speaker diaphragm 5. Accordingly, Young's modulus can be further increased. If aramid fiber is used for fabric layer 6, in addition to mixing of aramid fiber in paper layer 7, entire speaker diaphragm becomes configured with aramid fiber. This can further increase Young's modulus.

In the same way, fabric layer 6 is preferably a fabric containing at least one of hard fibers, such as aramid fiber, polyester fiber, acrylic fiber, cotton fiber, carbon fiber, glass fiber, and silk fiber. The use of a fabric containing these fibers improves hardness of fabric layer 6, and thus Young's modulus of speaker diaphragm 5 can be increased.

Next is described a method of manufacturing speaker diaphragm 5 in the first exemplary embodiment of the present invention.

Figure 4:
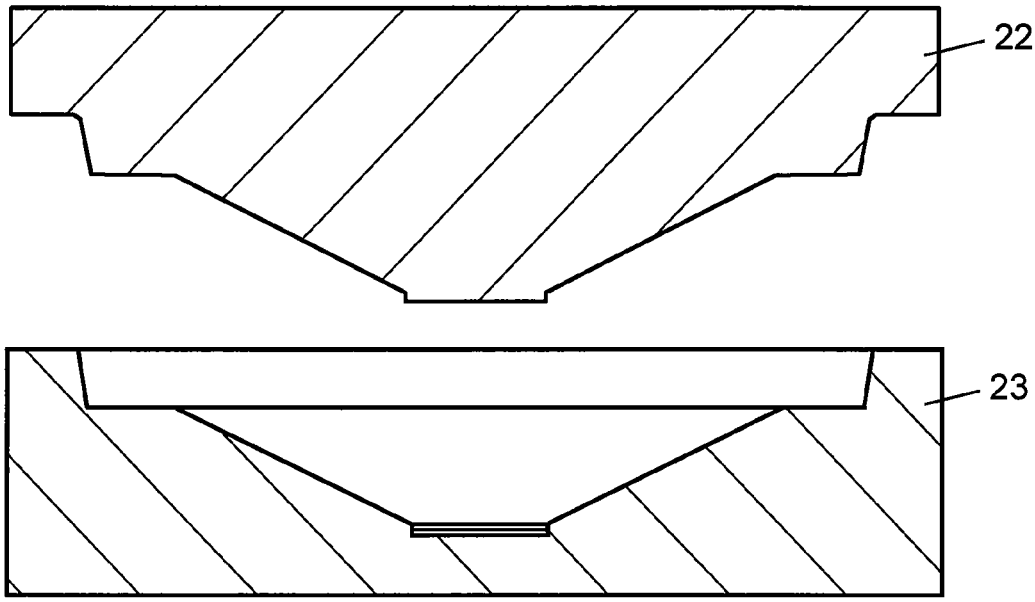
FIG. 4 is a molding machine configured with a first mold and a second mold for forming the speaker diaphragm in accordance with the first exemplary embodiment of the present invention.

FIG. 4 illustrates a molding machine configured with the first mold and the second mold for forming the speaker diaphragm in the first exemplary embodiment of the present invention. In FIG. 4, first mold 22 is a conic trapezoidal forming tool that protrudes downward. Second mold 23 has a bowl-like shape that fits with the conic trapezoidal shape of this first mold 22. A heater for heating (not illustrated) is attached to these first mold 22 and second mold 23.

Figure 5:
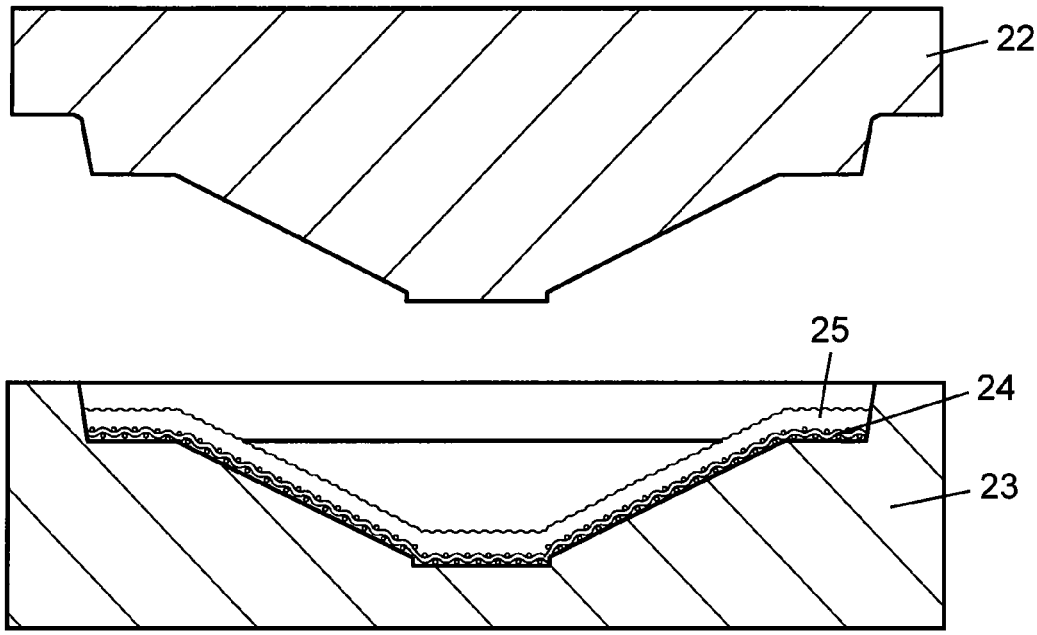
FIG. 5 is a sectional view illustrating a method of manufacturing the speaker diaphragm in accordance with the first exemplary embodiment of the present invention.

FIG. 5 is a sectional view illustrating the method of manufacturing the speaker diaphragm in the first exemplary embodiment of the present invention.

In FIG. 5, firstly, first mold 22 is separated upward from second mold 23. Then, bowl-like papermaking screen 24 is placed on second mold 23. Papermaking screen 24 is in a state that pulp, which is a raw material of paper layer 7, is scooped up from pulp solution, and pulp sedimentary layer 25 of pulp is formed on papermaking screen 24. Here, pulp sedimentary layer 25 is about 10 mm thick. In this state, the heater of second mold 23 is driven to heat and evaporate moisture in pulp sedimentary layer 25. Since first mold 22 is not pressed downward at this point, pulp sedimentary layer 25 is not compressed between first mold 22 and second mold 23. In other words, pulp sedimentary layer 25 is heated and dried without applying pressure. In the first exemplary embodiment of the present invention, only the heater attached to second mold 23 is driven. However, a heater attached to first mold 22 may also be driven at the same time in addition to the heater embedded in second mold 23. Alternatively, pulp sedimentary layer 25 may be dried by hot air typically of a drier or may be left to natural drying without driving the heater.

Figure 6:
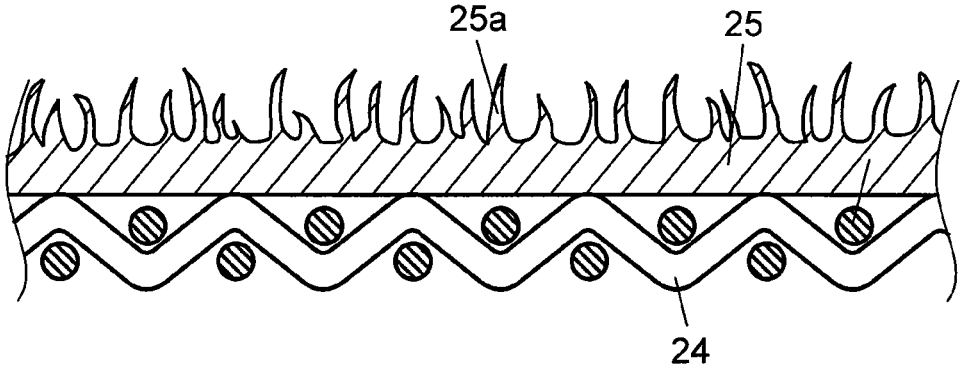
FIG. 6 is a sectional view of a raw material of the speaker diaphragm in accordance with the first exemplary embodiment of the present invention.

FIG. 6 is a sectional view of the raw material of the speaker diaphragm in the first exemplary embodiment of the present invention. In FIG. 6, pulp sedimentary layer 25 is dried keeping the state of the raw material being scooped up from the pulp solution if pulp sedimentary layer 25 is heated and dried without applying pressure. Accordingly, pulp in dried pulp sedimentary layer 25 on a face opposing first mold 22 contains numerous fluffs 25*a*, keeping a fluffy state. In the first exemplary embodiment of the present invention, pulp in pulp sedimentary layer 25 is further fluffed by giving dried pulp sedimentary layer 25 a light wire-brushing.

Figure 7:
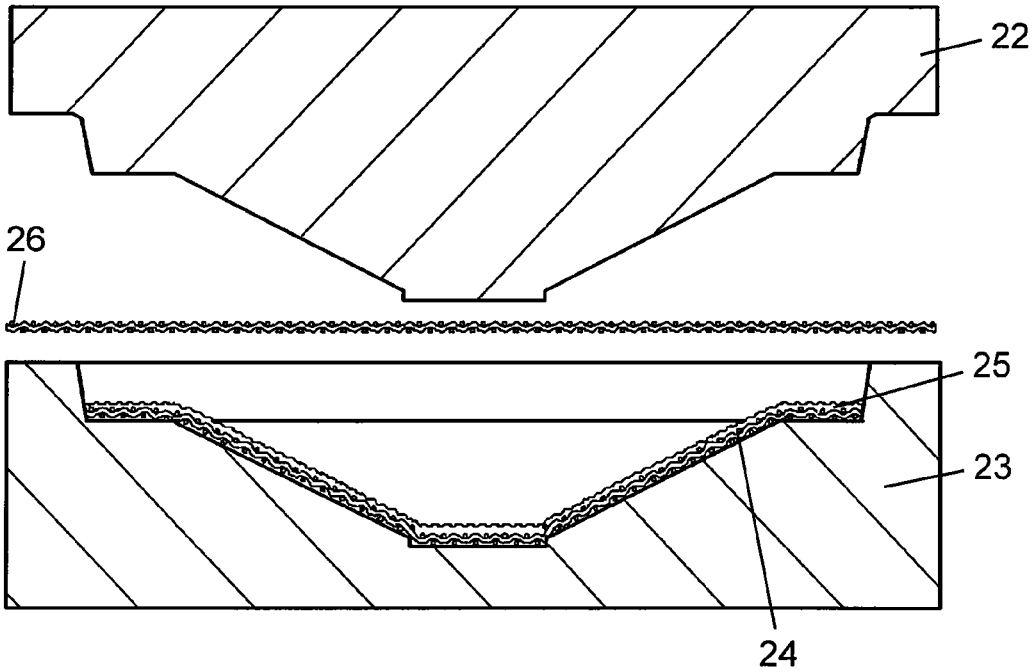
FIG. 7 is a sectional view illustrating a method of manufacturing the speaker diaphragm in accordance with the first exemplary embodiment of the present invention.

FIG. 7 is a sectional view illustrating the method of manufacturing the speaker diaphragm in the first exemplary embodiment of the present invention. In FIG. 7, flat fabric 26 before embossing is disposed between first mold 22 and second mold 23 where pulp sedimentary layer 25 and papermaking screen 24 are placed. This flat fabric 26 is a material that becomes fabric layer 6 after molding, and is formed by threads woven in a reticular pattern. Flat fabric 26 is impregnated with thermosetting resin containing at least one of thermosetting resins of phenol resin, acrylic resin, epoxy resin, and vinylester resin in advance.

Figure 8:
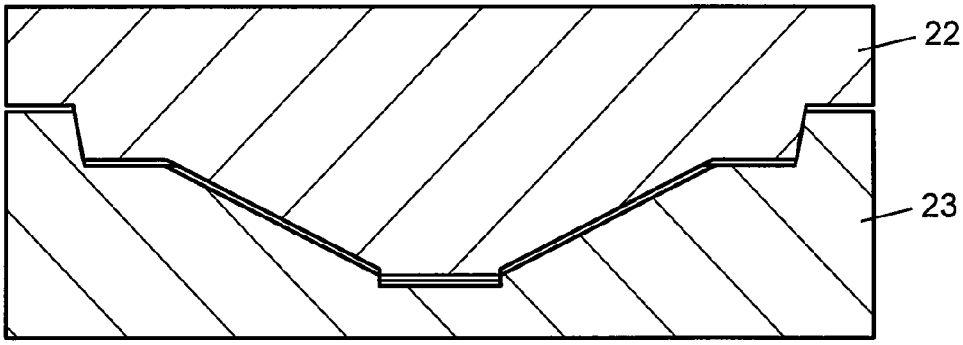
FIG. 8 is a sectional view illustrating the method of manufacturing the speaker diaphragm in accordance with the first exemplary embodiment of the present invention.

FIG. 8 is a sectional view illustrating the method of manufacturing the speaker diaphragm in the first exemplary embodiment of the present invention. In FIG. 8, first mold 22 is pressed down to second mold 23 to apply pressure and compress pulp sedimentary layer 25 and flat fabric 26. Since pulp in pulp sedimentary layer 25 is fluffed, fluffs 25*a* shown in FIG. 6 pass through stitches of flat fabric 26, protrude from the surface of flat fabric 26, and then are compressed. In other words, pulp sedimentary layer 25 and flat fabric 26 are clamped in the state that fluffs 25*a* of pulp sedimentary layer 25 are filled in stitches of flat fabric 26.

At this point, pulp sedimentary layer 25 and flat fabric 26 are deformed by pressure and compression, and become shapes of paper layer 7 and fabric layer 6 of speaker diaphragm 5 shown in FIG. 1B, respectively.

Furthermore, first mold 22 and second mold 23 are heated at temperatures between 180° C. and 250° C. in a state that pulp sedimentary layer 25 and flat fabric 26 are clamped, so as to integrate pulp sedimentary layer 25 and flat fabric 26 by thermally curing thermosetting rein in flat fabric 26. Then, first mold 22 and second mold 23 are opened, formed speaker diaphragm 5 is taken out, and papermaking screen 24 is peeled off. In the first exemplary embodiment of the present invention, the molds are clamped in the state that pulp sedimentary layer 25 and papermaking screen 24 are placed on second mold 23. However, papermaking screen 24 may be peeled off after heating and drying pulp sedimentary layer 25, and only flat fabric 26 and pulp sedimentary layer 25 may be clamped.

Speaker diaphragm 5 in the first exemplary embodiment is formed through the above processes.

In the method of manufacturing the speaker diaphragm in the first exemplary embodiment of the present invention, fluffs 25*a* in pulp sedimentary layer 25 on the face opposing first mold 22 are filled in stitches of flat fabric 26, and compression molding can be achieved in the state that fluffs are protruding from the surface of flat fabric 26. Accordingly, speaker diaphragm 5 can be achieved with the structure that fluffs become entangled with threads 9 from the surface of fabric layer 6, as shown in FIGS. 1A and 1B, and are fixed with thermosetting resin.

After drying pulp sedimentary layer 25, pulp sedimentary layer 25 may be further fluffed by giving a brushing using a wire brush or coarse sandpaper. Further fluffed pulp sedimentary layer 25 enables further more fluffs to enter stitches of flat fabric 26, and thus filling rate of fluffs 7*a* of paper layer 7 in stitches 10 can be increased in the manufacture of speaker diaphragm 5. In addition, more fluffs 7*a* of paper layer 7 become entangled with threads 9.

Furthermore, to make pulp sedimentary layer 25 more fluffy, fibers having a fibrillar structure including animal fiber such as wool, bast fiber such as hemp, or seed-pod fibers such as cotton and Kapok may be mixed in pulp that becomes a raw material of paper layer 7. More specifically, if fibers with a structure of bundled fine fiber elements, such as the fibrillar structure, are mixed, pulp sedimentary layer 25 becomes further fluffy because these fibers split at drying. Accordingly, more fluffs 25*a* can enter stitches of flat fabric 26. Furthermore, the layer can be further fluffed by giving a brushing using a wire brush or coarse sandpaper to pulp in which fiber with the fibrillar structure is mixed.

Second Exemplary Embodiment

Figure 9A:
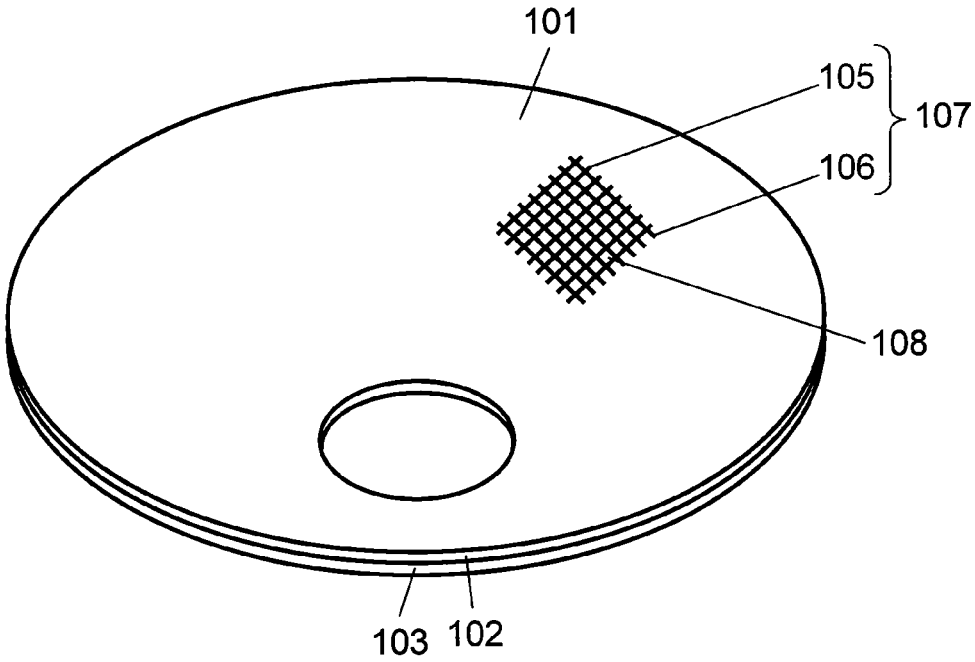
FIG. 9A is a perspective view of a speaker diaphragm in accordance with a second exemplary embodiment of the present invention.

FIG. 9A is a perspective view of a speaker diaphragm in the second exemplary embodiment of the present invention. In FIG. 9A, speaker diaphragm 101 has a two-layer structure of fabric layer 102 and nonwoven fabric layer 103. Fluff 104 of nonwoven fabric layer 103 is entangled with fabric layer 102, as described later. Fabric layer 102 is formed by weaving two types of thread 107, i.e., warp 105 and weft 106 in a reticular pattern. These reticular stripes are exposed on the surface of speaker when speaker diaphragm 101 is disposed on the speaker. Thermosetting resin (not illustrated) exists inside and on outer circumference of these warp 105 and weft 106. Warp 105 and weft 106 themselves and fabric layer 102 formed by weaving these threads are hardened by thermally curing this thermosetting resin.

This fabric layer 102 contains at least one of high-strength fiber such as aramid fiber, polyester fiber, acrylic fiber, cotton fiber, carbon fiber, glass fiber, and silk fiber. Thermosetting resin is resin containing at least one of phenol resin, acrylic resin, epoxy resin, and vinylester resin.

Nonwoven fabric layer 103 is formed by mixing bamboo fiber in softwood pulp fiber at content of 0.5 wt % to 20 wt %. The bamboo fiber mixed in this nonwoven fabric layer 103 is broken down to small freeness up to the microfibrillar state. Its average fiber diameter is 5 μm or less, which enables sufficient entanglement with softwood pulp fiber.

Nonwoven fabric layer 103 is integrated on the rear face of fabric layer 102 by thermocompression-bonding. Since nonwoven fabric layer 103 is integrated on the rear face of fabric layer 102 by thermocompression-bonding, air does not pass through from the surface to the rear face of speaker diaphragm 101.

Furthermore, the bamboo fiber and softwood pulp fiber configuring this nonwoven fabric layer 103 fill each stitch 108 surrounded by adjacent warp 105 and weft 106 of fabric layer 102.

Figure 9B:
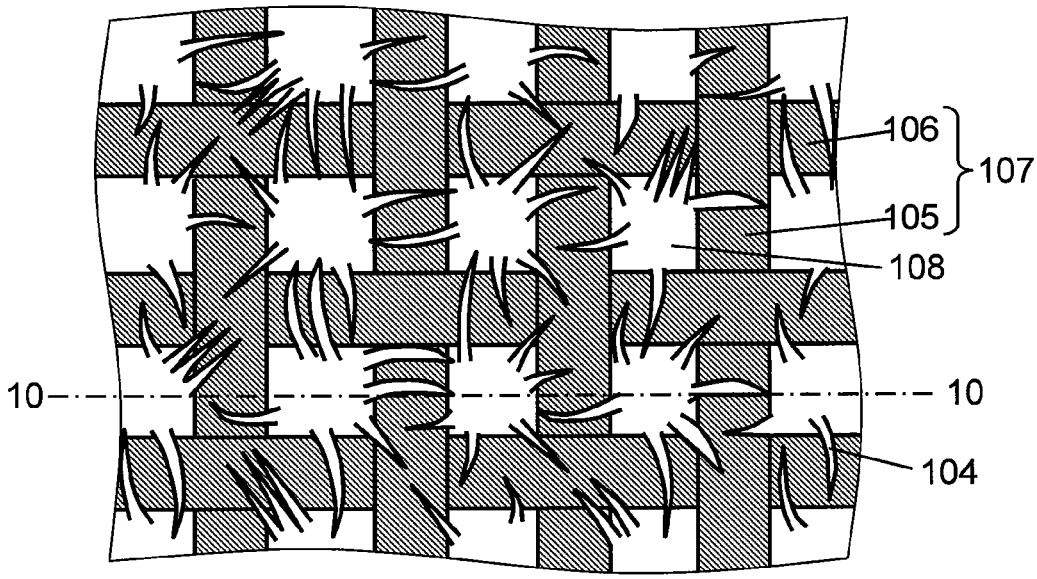
FIG. 9B is a magnified view of an essential part seen from the surface of the speaker diaphragm in accordance with the first exemplary embodiment of the present invention.

FIG. 9B is a magnified view of an essential part seen from the surface of the speaker diaphragm in the first exemplary embodiment of the present invention. In FIG. 9B, fluffs 104 of the bamboo fiber and softwood pulp fiber in nonwoven fabric layer 103 become entangled with warp 105 and weft 106 from the surface (the face opposite to the attachment face of nonwoven fabric layer 103) of fabric layer 102. Fluff 104 is hardened together with thread 107 by thermosetting resin. In other words, fabric layer 102 and nonwoven fabric layer 103 are pressure-bonded and integrated by the bamboo fiber, in addition to pressure-bonding and integration of fabric layer 102 and nonwoven fabric layer 103, by curing thermosetting resin by heat in speaker diaphragm 101. Strictly-speaking, stitch 108 is a substantially cuboid portion whose bottom face is surrounded by warp 105 and weft 106.

Figure 10:
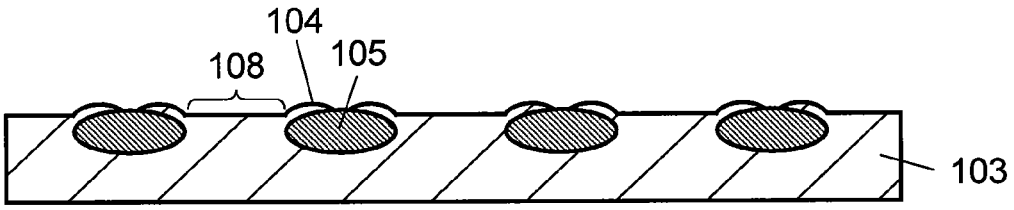
FIG. 10 is a schematic sectional view taken along dotted line 10-10 in FIG. 9B.

FIG. 10 is a schematic sectional view taken along dotted line 10-10 in FIG. 9B. In FIG. 10, stitch 108 between warps 105 is filled with the bamboo fiber and softwood pulp fiber of nonwoven fabric layer 103 in speaker diaphragm 101. These layers are thermocompression-bonded in a state that fluffs 104 of the bamboo fiber and softwood pulp fiber in nonwoven fabric layer 103 are entangled with warp 105 from the surface of fabric layer 102. Fluff 104 is entangled with warp 105 in the drawing, but fluff 104 is also entangled with weft 106, in the same way as warp 105.

Figure 11:
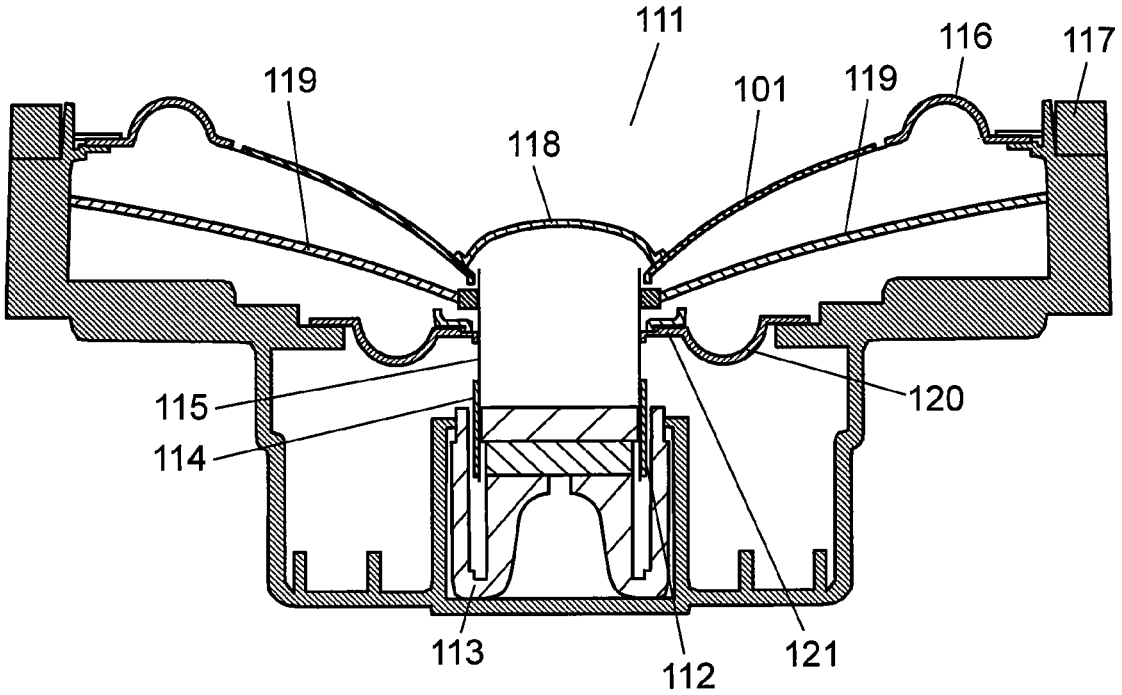
FIG. 11 is a sectional view of a speaker employing the speaker diaphragm in accordance with the second exemplary embodiment of the present invention.

FIG. 11 is a sectional view of a speaker employing the speaker diaphragm in the second exemplary embodiment of the present invention. In FIG. 11, speaker 111 includes magnetic circuit 113 having cylindrical magnetic gap 112, and cylindrical voice coil 115 in which coil 114 is movably disposed inside this magnetic gap 112.

An inner circumference of conic speaker diaphragm 101 is connected to an outer circumference near the upper end of this voice coil 115. The outer circumference of this speaker diaphragm 101 is connected to bowl-like frame 117 at an opening on the top face via ring-like first edge 116. Dome-like dust cap 118 is provided near the inner circumference of this speaker diaphragm 101 so as to cover the top face of voice coil 115. This dust cap 118 prevents entry of dust or moisture into magnetic gap 112.

Leader line 119 from coil 114 of voice coil 115 is led out from an upper part of this voice coil 115 to outside frame 117 without making contact with speaker diaphragm 101. An AC current, in which an audio signal is added, travels from outside the speaker to coil 114 via this leader line 119.

An inner circumference end of resilient second edge 120, which has a ring-like planar shape, is connected to this voice coil 115 via suspension holder 121 at a portion between a lead-out point of leader line 119 and a portion inside magnetic gap 112. The other end of this second edge 120 is connected to an inner middle portion of frame 117.

These second edge 120 and first edge 116 are formed of a resilient material such as urethane or rubber. These edges have shapes protruding in opposite directions: second edge 120 protruding downward and first edge 116 protruding upward.

The shapes of first edge 116 and second edge 120 protruding in opposite directions to each other make upward and downward movable loads of voice coil 115 approximately balanced.

Accordingly, vertical operation of speaker diaphragm 101 also becomes vertically symmetric. As a result, distortion in the sound reproduced from speaker 111 can be reduced.

When audio signal travels in voice coil 115 of speaker 111 as configured above, the audio signal reacts with a magnetic field formed by magnetic gap 112, and a drive force is generated in voice coil 115. This driving direction follows the Fleming's left-hand rule, and voice coil 115 fluctuates vertically. By fluctuation of this voice coil 115, speaker diaphragm 101, whose inner circumference is connected to voice coil 115, also vertically vibrates. This vibrates air, and the sound is generated from speaker 111.

However, when a speaker diaphragm is formed by overlaying materials such as fabric and paper, they cannot be fully integrated because of their different natures. As a result, it is difficult to demonstrate the maximum effect of high Young's modulus of the fabric layer and high internal loss of the nonwoven fabric layer, which are firmly fixed by thermosetting resin, in the speaker diaphragm configured in this way. Accordingly, the sound quality of speaker has not been sufficiently improved.

Therefore, speaker diaphragm 101 in the second exemplary embodiment has a structure of mixing bamboo fiber in nonwoven fabric layer 103.

In nonwoven fabric layer 103, in which the bamboo fiber is mixed, the bamboo fiber likely rises against the surface of nonwoven fabric layer 103 because of its highly rigid and strong characteristic. Therefore, many fluffs 104 of bamboo fiber rise against the surface of nonwoven fabric layer 103, and these fluffs 104 fill stitches 108 of woven fabric layer 102. Since fluffs 104 are filled in stitches 108 of woven fabric layer 102, and two layers are thermocompression-bonded and integrated by thermosetting resin in a state fluffs 104 are entangled with threads 107 of fabric layer 102, fabric layer 102 and nonwoven fabric layer 103 are firmly integrated.

Accordingly, fabric layer 102 and nonwoven fabric layer 103 are sufficiently integrated in speaker diaphragm 101 in the second exemplary embodiment of the present invention, compared to conventional speaker diaphragm 204 (see FIG. 17) in which only the rear face of fabric layer 102 is generally attached to nonwoven fabric layer 103. As a result, effects of high Young's modulus of the fabric layer and high internal loss of the nonwoven fabric layer can be sufficiently demonstrated.

In addition, since the bamboo fiber has high rigidity and strength, Young's modulus of speaker diaphragm 101 is further increased by this rigidity and strength of the bamboo fiber.

As described above, speaker diaphragm 101 in the second exemplary embodiment of the present invention can increase internal loss and Young's modulus, and thus the sound quality of speaker 111 can be improved. In addition, as described above, fabric layer 102 and nonwoven fabric layer 103 are firmly integrated in speaker diaphragm 101 in the second exemplary embodiment of the present invention. This also significantly reduces a chance of separation of fabric layer 102 and nonwoven fabric layer 103.

Speaker diaphragm 101 in the second exemplary embodiment of the present invention that uses the bamboo fiber as a material mixed in nonwoven fabric layer 103 also excels in cost and environmental aspects. More specifically, softwood that has been used as a material for the conventional speaker diaphragm is cut down worldwide for various purposes other than for speaker diaphragms. Therefore, softwood shortages are in concern at present. On the other hand, bamboos exist more, centering on Asia, compared to softwood. In addition, extremely high growth speed of bamboo is assumed to give no detrimental effect on environment like the case of cutting softwood. Under these circumstances, the bamboo fiber is mixed in nonwoven fabric layer 103 in the second exemplary embodiment of the present invention to reduce the percentage of softwood pulp fiber in nonwoven fabric layer 103. As a result, speaker diaphragm 101 in the second exemplary embodiment of the present invention can be manufactured at low cost without giving a detrimental effect on environment.

Still more, in the second exemplary embodiment of the present invention, the bamboo fiber mixed in nonwoven fabric layer 103 is broken down to the microfibrillar state whose average fiber diameter is 5 μm or less. By mixing bamboo fiber broken down to the microfibrillar state, the bamboo fiber and softwood pulp fiber can be further entangled. This improves Young's modulus of the speaker diaphragm.

In the second exemplary embodiment, the average fiber diameter of the bamboo fiber mixed in nonwoven fabric layer 103 is 5 μm or less. However, the average fiber diameter of bamboo fiber may also be 5 μm or more. The use of bamboo fiber with average fiber diameter of 5 μm or more may have less strength in entanglement of the bamboo fiber and softwood pulp fiber, but it still shows sufficiently high Young's modulus and internal loss, compared to that of the conventional diaphragm. Furthermore, nonwoven fabric layer 103 may be configured only with the bamboo fiber to form speaker diaphragm 101. In this case, original nature of bamboo fiber, i.e., rigidity and strength, is demonstrated, and high Young's modulus can be achieved compared to that of the conventional speaker diaphragm.

Thermosetting resin contained in fabric layer 102 is preferably resin at least containing one of phenol resin, acrylic resin, epoxy resin, and vinylester resin. Any resin containing one of these resins fully cures at thermocompression-bonding and increases hardness of speaker diaphragm 101. This can increase Young's modulus of speaker diaphragm 101.

Aramid fiber may be mixed in nonwoven fabric layer 103. By mixing aramid fiber, which is hard, in nonwoven fabric layer 103, speaker diaphragm 101 can be strengthened, accompanied by increased hardness of speaker diaphragm 101. Accordingly, Young's modulus can be further increased. Also in the case of mixing aramid fiber, as described above, the bamboo fiber can be sufficiently entangled with aramid fiber by breaking down the bamboo fiber to the microfibrillar state. The characteristic of bamboo fiber can thus be demonstrated.

In the same way, fabric layer 102 is preferably a fabric containing at least one of hard fibers, such as aramid fiber, polyester fiber, acrylic fiber, cotton fiber, carbon fiber, glass fiber, and silk fiber. The use of fabric containing these fibers improves hardness of fabric layer 102, and thus Young's modulus of speaker diaphragm can be increased.

In a speaker employing this speaker diaphragm 101, a reticular pattern of fabric layer 102 is preferably exposed on the speaker surface.

In other words, generation of local resonance in speaker diaphragm can be prevented by adopting a structure that the reticular pattern woven by warps 105 and wefts 106, as shown in FIG. 9A, is exposed on the speaker surface when speaker diaphragm 101 is installed in the speaker.

Next is described a method of manufacturing speaker diaphragm 101 in the second exemplary embodiment of the present invention.

Figure 12:
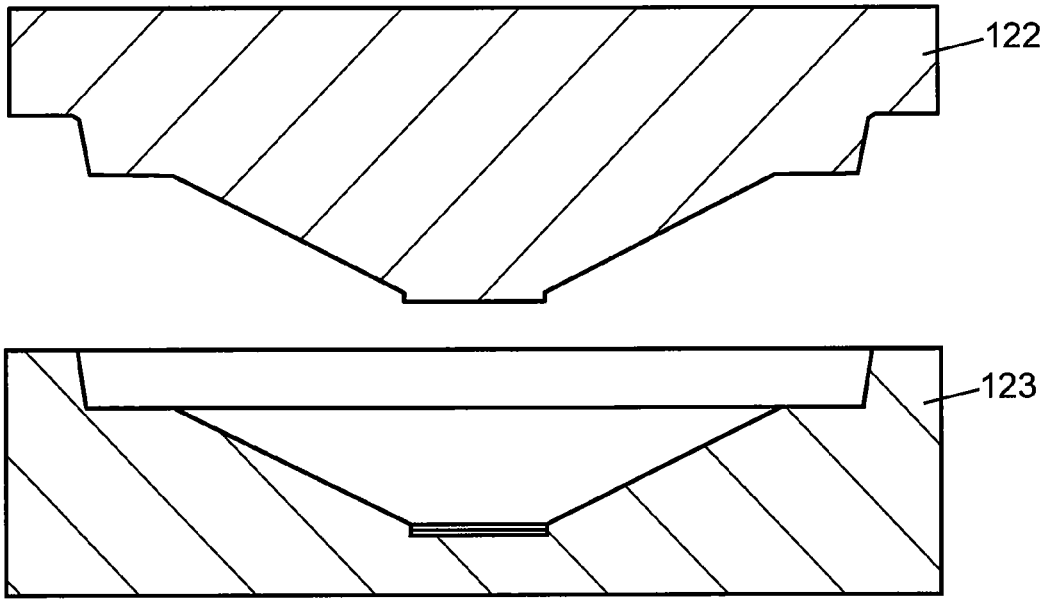
FIG. 12 is a molding machine configured with a first mold and a second mold for forming the speaker diaphragm in accordance with the second exemplary embodiment of the present invention.

FIG. 12 illustrates a molding machine configured with the first mold and the second mold for forming the speaker diaphragm in the second exemplary embodiment of the present invention. In FIG. 12, first mold 122 is a conic trapezoidal forming tool that protrudes downward.

Second mold 123 has a bowl-like shape that fits with the conic trapezoidal shape of this first mold 122. A heater for heating (not illustrated) is attached to these first mold 122 and second mold 123.

Figure 13:
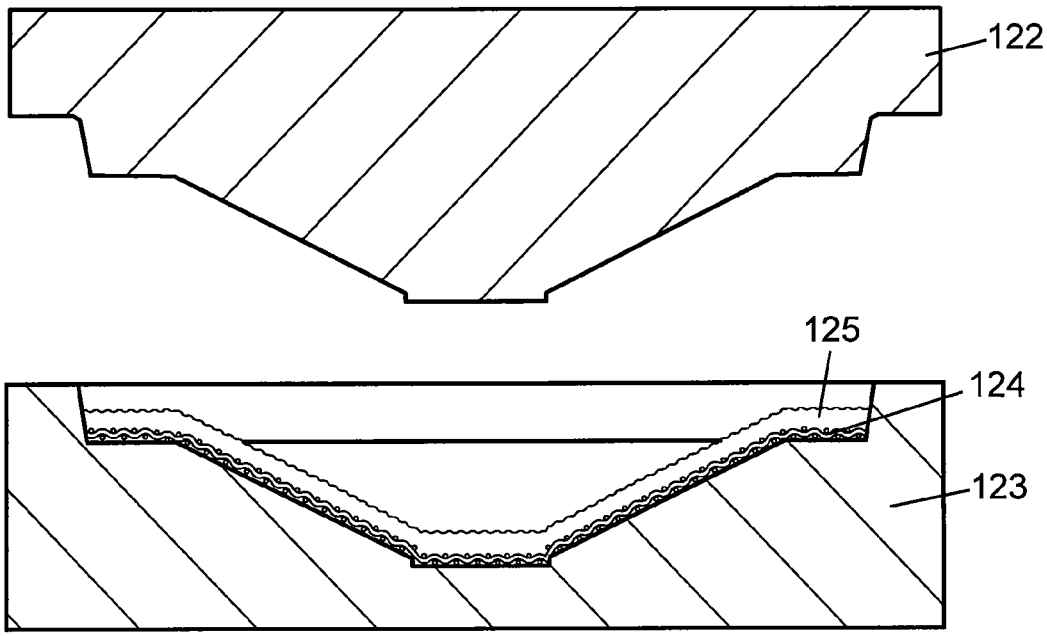
FIG. 13 is a sectional view illustrating a method of manufacturing the speaker diaphragm in accordance with the second exemplary embodiment of the present invention.

FIG. 13 is a sectional view illustrating the method of manufacturing the speaker diaphragm in the second exemplary embodiment of the present invention.

In FIG. 13, firstly, first mold 122 is separated upward from second mold 123. Next, bowl-like papermaking screen 124 is placed on second mold 123. Papermaking screen 124 is in a state that softwood pulp fiber and bamboo fiber, which are raw materials of nonwoven fabric layer 103, are scooped up from a solution tank, and about 10-mm thick sedimentary layer 125 of fibers and bamboo fibers are formed on papermaking screen 124. Since fibrillated bamboo fibers are uniformly mixed in the solution tank, bamboo fibers also uniformly exist in sedimentary layer 125, and they are randomly oriented. Amount of bamboo fibers mixed in the solution tank is adjusted such that bamboo fibers become 0.5 wt % to 20 wt % when moisture in sedimentary layer 125 is evaporated.

In this state, the heater of second mold 123 is driven to heat and evaporate moisture in sedimentary layer 125. Since first mold 122 is not pressed downward at this point, sedimentary layer 125 is not compressed between first mold 122 and second mold 123. In other words, sedimentary layer 125 is heated and dried without applying pressure. In the second exemplary embodiment of the present invention, only the heater attached to second mold 123 is driven. However, a heater attached to first mold 122 may also be driven at the same time, in addition to the heater embedded in second mold 123. Alternatively, sedimentary layer 125 may be dried by hot air typically of a drier, or may be left to natural drying without driving the heaters.

Figure 14:
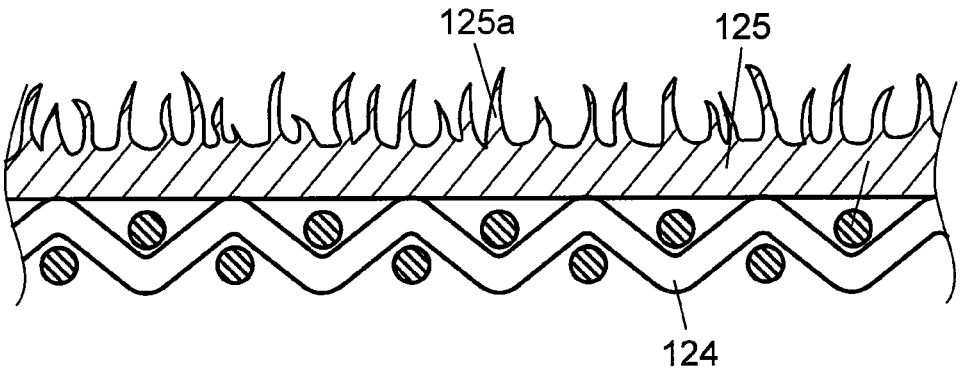
FIG. 14 is a sectional view of a raw material of the speaker diaphragm in accordance with the second exemplary embodiment of the present invention.

FIG. 14 is a sectional view of the raw materials of the speaker diaphragm in the second exemplary embodiment of the present invention. In FIG. 14, sedimentary layer 125 is dried keeping the state of the raw materials being scooped up from the pulp solution if sedimentary layer 125 is heated and dried without applying pressure. Accordingly, numerous fluffs 125*a* are generated from bamboo fibers and softwood pulp fibers in dried sedimentary layer 125 on a face opposing first mold 122. The surface of sedimentary layer 125 is thus fluffed.

In particular, fluffs 125*a* of bamboo fibers rise against the surface of sedimentary layer 125, compared to softwood pulp fibers. This is because bamboo fibers tend to retain their state before drying due to its high rigidity and strength, compared to softwood pulp fiber, while dried softwood pulp fibers tend to lie on the surface of sedimentary layer 125 and align along the surface of sedimentary layer 125 (a state that they lie on the surface). More specifically, bamboo fibers oriented to directions other than the direction along the surface of sedimentary layer 125 before drying retain their positions at heating and drying. As a result, these bamboo fibers rise against the surface of sedimentary layer 125 after drying.

In other words, in randomly-oriented bamboo fibers in sedimentary layer 125 before drying, bamboo fibers exist on the surface of sedimentary layer 125 and are not aligned along the surface of sedimentary layer 125 become fluffs 125*a*.

Figure 15:
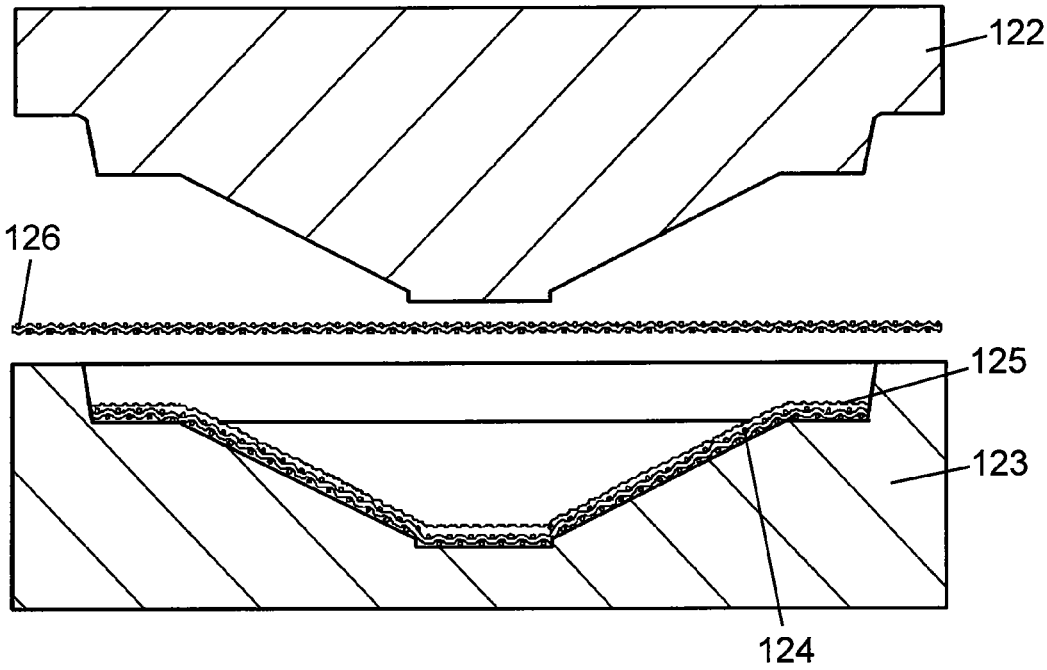
FIG. 15 is a sectional view illustrating the method of manufacturing the speaker diaphragm in accordance with the second exemplary embodiment of the present invention.

FIG. 15 is a sectional view illustrating the method of manufacturing the speaker diaphragm in the second exemplary embodiment of the present invention. In FIG. 15, flat fabric 126 before embossing is disposed between first mold 122 and second mold 123 where sedimentary layer 125 and papermaking screen 124 are placed. This flat fabric 126 is a material that becomes fabric layer 102 after molding, and is formed by threads woven in a reticular pattern. Flat fabric 126 is impregnated with thermosetting resin containing at least one of thermosetting resins of phenol resin, acrylic resin, epoxy resin, and vinylester resin in advance.

Figure 16:
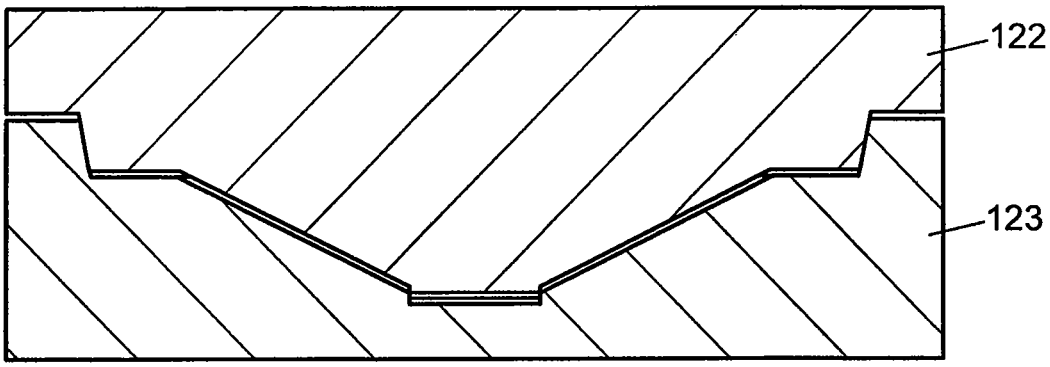
FIG. 16 is a sectional view illustrating the method of manufacturing the speaker diaphragm in accordance with the second exemplary embodiment of the present invention.

FIG. 16 is a sectional view illustrating the method of manufacturing the speaker diaphragm in the second exemplary embodiment of the present invention. In FIG. 16, first mold 122 is pressed down to second mold 123 to apply pressure and compress sedimentary layer 125 and flat fabric 126. Since bamboo fibers and softwood pulp fibers in sedimentary layer 125 are fluffed, fluffs 12*a* shown in FIG. 14 pass through stitches of flat fabric 126, protrude from the surface of flat fabric 126, and then are compressed. In other words, sedimentary layer 125 and flat fabric 126 are clamped in the state that fluffs 125*a* of bamboo fibers and softwood pulp fibers in sedimentary layer 125 are filled in stitches of flat fabric 126.

At this point, sedimentary layer 125 and flat fabric 126 are deformed by pressure and compression, and become shapes of nonwoven fabric layer 103 and woven fabric layer 102 of speaker diaphragm 101 shown in FIG. 9A, respectively.

Furthermore, first mold 122 and second mold 123 are heated at temperatures between 180° C. to 250° C. in a state that sedimentary layer 125 and flat fabric 126 are clamped so as to integrate sedimentary layer 125 and flat fabric 126 by thermally curing thermosetting resin in flat fabric 126. In other words, sedimentary layer 125 and flat fabric 126 are integrated by applying heat, and they are also integrated by fluffs 125*a* entangled with flat fabric 126.

Then, first mold 122 and second mold 123 are opened, formed speaker diaphragm is taken out, and papermaking screen 124 is peeled off. In the second exemplary embodiment of the present invention, the molds are clamped in the state that sedimentary layer 125 and papermaking screen 124 are placed on second mold 123. However, papermaking screen 124 may be peeled off after heating and drying sedimentary layer 125, and only flat fabric 125 and sedimentary layer 125 may be clamped.

Speaker diaphragm 101 in the second exemplary embodiment is formed by cutting unnecessary portions after the above processes.

In the method of manufacturing the speaker diaphragm in the second exemplary embodiment of the present invention, fluffs 125*a* in sedimentary layer 125 on the face opposing first mold 122 are filled in stitches of flat fabric 126, and compression-molding can be achieved in the state that fluffs 125*a* are protruding from the surface of flat fabric 126. Accordingly, speaker diaphragm 101 can be achieved with the structure that fluffs 104 become entangled with threads 107 from the surface of fabric layer 102, as shown in FIGS. 9A and 9B, and are firmly fixed by thermosetting resin.

INDUSTRIAL APPLICABILITY

The speaker diaphragm of the present invention has a structure that the paper layer and fabric layer are integrated by firmly fixing these layers by thermosetting resin while fluffs of the paper layer are entangled with threads from the surface of the fabric layer. This can increase internal loss and Young's modulus of the speaker diaphragm.

Furthermore, the speaker diaphragm of the present invention has the structure that bamboo fibers are mixed in the nonwoven fabric layer. Fluffs of bamboo fibers, in addition to fluffs of the nonwoven fabric layer, are filled in stitches of the fabric layer, and these fluffs are entangled with threads from the surface of the fabric layer. This firmly integrates the woven fabric layer and nonwoven fabric layer, increasing internal loss and Young's modulus of the speaker diaphragm.

Accordingly, the speaker diaphragm of the present invention can improve the speaker sound quality, and is thus effectively applicable to a range of audio equipment.

The invention claimed is:

1. A speaker comprising:

a speaker diaphragm including:

a fabric layer impregnated with thermosetting resin, the thermosetting resin being thermally cured; and a paper layer integrated on a rear face of the fabric layer;

wherein fluffs of the paper layer pass through stitches of the fabric layer which are intertwined and protrude from a front surface of the fabric layer and over the stitches, the fluffs of the paper layer are entangled with threads of the fabric layer from the front surface of the fabric layer, and is integrated by the thermosetting resin, and a frame connected to the speaker diaphragm a magnetic circuit held by the frame; and a voice coil disposed in a magnetic gap of the magnetic circuit.

2. The speaker of claim 1, wherein resin containing at least one of phenol resin, acrylic resin, epoxy resin, and vinylester resin is used as the thermosetting resin contained in the fabric layer.

3. The speaker of claim 1, wherein aramid fiber is mixed in the paper layer.

4. The speaker of claim 1, wherein the fabric layer contains at least one of aramid fiber, polyester fiber, acrylic fiber, cotton fiber, carbon fiber, glass fiber, and silk fiber.

5. A speaker comprising:

a speaker diaphragm including an integrated fabric layer and paper layer manufactured by a molding machine, wherein a pulp that is a material of the paper layer is scooped up with a papermaking screen, and the pulp of the paper layer is manufactured and a front surface of the pulp is fluffed by drying without applying pressure using the molding machine before laying a fabric that is a material of the fabric layer on the front surface of the pulp and applying pressure to the fabric and the pulp with the molding machine, and fluffs of the paper layer pass through stitches of the fabric layer which are intertwined and protrude from a front surface of the fabric layer and over the stitches, the fluffs of the paper layer are entangled with threads of the fabric layer from the front surface of the fabric layer, and is integrated by the thermosetting resin, and a frame connected to the speaker diaphragm a magnetic circuit held by the frame; and a voice coil disposed in a magnetic gap of the magnetic circuit.

6. A speaker comprising:

a speaker diaphragm including:

a fabric layer impregnated with thermosetting resin; and a nonwoven fabric layer provided on a rear face of the fabric layer; wherein a bamboo fiber is mixed in the nonwoven fabric layer, and a fluff of the nonwoven fabric layer passes through a stitch of the fabric layer and protrudes from a front surface of the fabric layer, the fluff of the nonwoven fabric layer is entangled with a thread of the fabric layer from the front surface of the fabric layer, and is integrated by the thermosetting resin, and a frame connected to the speaker diaphragm a magnetic circuit held by the frame; and a voice coil disposed in a magnetic gap of the magnetic circuit.

7. The speaker of claim 6, wherein the bamboo fiber mixed in the nonwoven fabric layer is in a microfibrillar state.

8. The speaker of claim 1, wherein a reticular pattern of the fabric layer in the speaker diaphragm is exposed on a surface of the speaker diaphragm.

9. The speaker of claim 5, wherein the pulp is fluffed by giving a brushing.

10. The speaker of claim 5, wherein a fiber having a fibrillar structure is mixed in the pulp.

11. A method of forming a speaker, said method comprising the steps of:

forming a speaker diaphragm comprising an integrated fabric layer and paper layer manufactured by a molding machine by performing the steps of:

scooping up a pulp that is a material of the paper layer with a papermaking screen, and the pulp of the paper layer is manufactured and a front surface of the pulp is fluffed by drying without applying pressure using the molding machine before laying a fabric that is a material of the fabric layer material on the front surface of the pulp and applying pressure to the fabric and the pulp with the molding machine, and fluffs of the paper layer pass through stitches of the fabric layer which are intertwined and protrude from a front surface of the fabric layer and over the stitches, the fluffs of the paper layer are entangled with threads of the fabric layer from the front surface of the fabric layer, and is integrated by the thermosetting resin; and providing a frame connected to the speaker diaphragm providing a magnetic circuit held by the frame; and providing a voice coil disposed in a magnetic gap of the magnetic circuit.

12. The speaker of claim 1, wherein integration of the fluff of the paper layer with the fabric layer provides a gain of an internal loss of the speaker diaphragm.

13. The speaker of claim 1, wherein integration of the fluff of the paper layer with the fabric layer provides a gain of Young's modulus of the speaker diaphragm.

* * * * *